US005823485A

United States Patent [19]

Park

[11] Patent Number: 5,823,485

[45] Date of Patent: Oct. 20, 1998

[54] AUTOMATICALLY FOLDABLE SUPPORT STAND FOR GOLF BAG

[75] Inventor: Soo-Young Park, Kyunggi-do, Rep. of Korea

[73] Assignee: Min-Jae Chun, Seoul, Rep. of Korea

[21] Appl. No.: 548,810

[22] Filed: Jan. 11, 1996

[30] Foreign Application Priority Data

Jan. 9, 1995 [KR] Rep. of Korea ..... 95-209

[51] Int. Cl.[6] ..... A63B 55/00

[52] U.S. Cl. ..... 248/96; 206/315.7; 248/169

[58] Field of Search ..... 248/96, 169, 163.1, 248/166; 206/315.7; 403/113, 117

[56] References Cited

U.S. PATENT DOCUMENTS

| | | | |
|---|---|---|---|
| 3,030,128 | 4/1962 | Versen | 403/113 X |
| 5,147,089 | 9/1992 | Anderson | 248/96 |
| 5,152,483 | 10/1992 | Maeng . | |
| 5,154,377 | 10/1992 | Suk | 248/96 |
| 5,209,350 | 5/1993 | Maeng | 248/96 X |
| 5,236,085 | 8/1993 | Quellais | 248/96 X |
| 5,339,951 | 8/1994 | Chen | 206/315.7 |
| 5,340,063 | 8/1994 | Hsieh | 206/315.7 X |
| 5,464,180 | 11/1995 | Cheng | 206/315.7 X |

FOREIGN PATENT DOCUMENTS

| | | | |
|---|---|---|---|
| 2098075 | 11/1982 | United Kingdom | 248/96 |

*Primary Examiner*—Derek J. Berger
*Attorney, Agent, or Firm*—Snell & Wilmer

[57] ABSTRACT

Disclosed is an automatically foldable support stand for a golf bag. The support stand includes a pair of legs and a V-shaped elastic rod adapted to move the legs between spread position and retracted position according to the movement of a bag body between its tiled position and its upright position. A free end of the elastic rod is engaged with an engagement groove of a base plate. An elasticity enforcing part integrally formed to the base plate is engaged with the elastic rod thereby substantially shortening a coincidence point of the V-shaped elastic rod. A guide shoe attached at a lower position of the golf bag penetrates through a guide block which is vertically extended from the base plate whereby a movement of the base plate is guided along a path controlled by the guide shoe. Besides, the legs interconnected to the elastic rod can be spread by a predetermined angular range set by a stopper protrudingly formed at a predetermined circumferential portion of a connection shaft of the legs and an enlarged bore portion formed at an inner peripheral surface of each of a pair of connection holes or a corresponding bracket.

2 Claims, 6 Drawing Sheets

AUTOMATICALLY FOLDABLE SUPPORT STAND FOR GOLF BAG

BACKGROUND OF THE INVENTION

1. Field of the Invention

The present invention relates to a golf bag and, more specifically, to an automatically foldable support stand for a golf bag, which is installed on the golf bag and automatically spread and retracted to provide an adequate support for the golf bag in a tilted posture.

2. Description of the Prior Art

Golf is a game played by a golfer touring a wide golf course with many golf clubs, and, therefore, the golfer needs an equipment for carrying the golf clubs. So far the golf bag is a common equipment for carrying the golf clubs conveniently.

While the golf bag is convenient to carry and handle, it is inconvenient to put in or pull out the golf clubs since the golf bag vertically stands on the ground. This inconvenience can be overcome by providing legs on the golf bag, which support the golf bag in the tilted posture. In this case, however, the user should manually spread and retract the legs.

U.S. Pat. No. 5,152,483 issued to Maeng discloses a golf bag having a support stand which solves the inconvenience of manually spreading and retracting the legs, Referring to FIGS. 5A and 5B, this conventional golf bag has a pair of legs 53 and a U-shaped actuating member 55 adapted to move the legs 53 between their spread position and their retracted position according to the movement of a bag body 51 between its tiled position and its upright position. The golf bag also has a driving member 57 pivotally connected to both of the lower end of the U-shaped actuating member 55 and the lower portion of the bag body 51 and adapted to drive the U-shaped actuating member 55 in response to the movement of the bag body 51 to its tilted position so that the U-shaped actuating member 55 moves the legs 53 to their spread position. A resilient rubber band 59 is provided for always urging the legs 53 toward their retracted position.

While this golf bag is advantageous in that its structure is simple, on the other hand, this golf bag has a problem that the stability of the golf bag when the legs 53 are spread sorely depends on the rigidity of the U-shaped actuating member 55.

That is, as shown in FIG. 5B, since the legs 53 when spread are supported by the U-shaped actuating member 55 which exhibits elasticity throughout its length, the U-shaped actuating member 55 should have high strength to exhibit enough rigidity throughout its length. In case the U-shaped actuating member 55 does not have the strength, the U-shaped actuating member 55 tends to deflect too much such that the golf bag will become unstable. Therefore, to support the golf bag in a stable posture, the U-shaped actuating member 55 should be thick, which will increase the production cost and weight of the golf bag.

SUMMARY OF THE INVENTION

An object of the present invention is to provide an automatically foldable support stand for a golf bag having an improved structure wherein a relatively slender elastic rod is adopted to exhibit an enough elasticity, To accomplish aforementioned objects, according to the present invention, an automatically foldable support stand for a golf bag having a V-shaped elastic rod actuated by a variation of weight of the golf bag, the V-shaped elastic rod being raised or lowered along a guide installed on a lower end of the golf bag thereby spreading or retracting a pair of legs interconnected to the V-shaped elastic rod to support the golf bag in a tilted posture, characterized in that a free end of the elastic rod is engaged with an engagement groove of a widely expanded semicircular base plate; an elasticity enforcing part integrally formed to the base plate is engaged with the elastic rod at a position between an upper end and lower end of the elastic rod thereby substantially shortening a coincidence point of the V-shaped elastic rod; a guide shoe attached at a lower position of the golf bag penetrates through a guide block which is vertically extended from the base plate whereby a movement of the base plate is guided along a path controlled by the guide shoe; and the legs interconnected to the elastic rod can be spread by a predetermined angular range set by a stopper protrudingly formed at a predetermined circumferential portion of a connection shaft of the legs and an enlarged bore portion formed at an inner peripheral surface of each of a pair of connection holes of a corresponding bracket.

BRIEF DESCRIPTION OF THE DRAWINGS

FIGS. 3A.and 3B are partial sectional views illustrating a structure for connecting an elastic rod and a base plate of the support stand of FIG. 1, wherein FIG. 3A shows a state when the golf bag stands upright.

FIGS. 4A and 4B are partial sectional views illustrating a structure for connecting the legs, wherein FIG. 4A shows a state when the legs are retracted, and FIG. 4B shows a state when the legs are spread.

Figs. 5A and 5B are perspective views illustrating a conventional golf bag with a support stand wherein FIG. 5A shows a state when the golf bag stands upright, and FIG. 5B shows a state when the golf bag is tilted with respect to the ground.

BRIEF DESCRIPTION OF THE PREFERRED EMBODIMENT

A preferred embodiment of the automatic foldable support stand according to the present invention, applied to a conventional golf bag, will be explained below with reference to the accompanying drawings.

Figure 1:
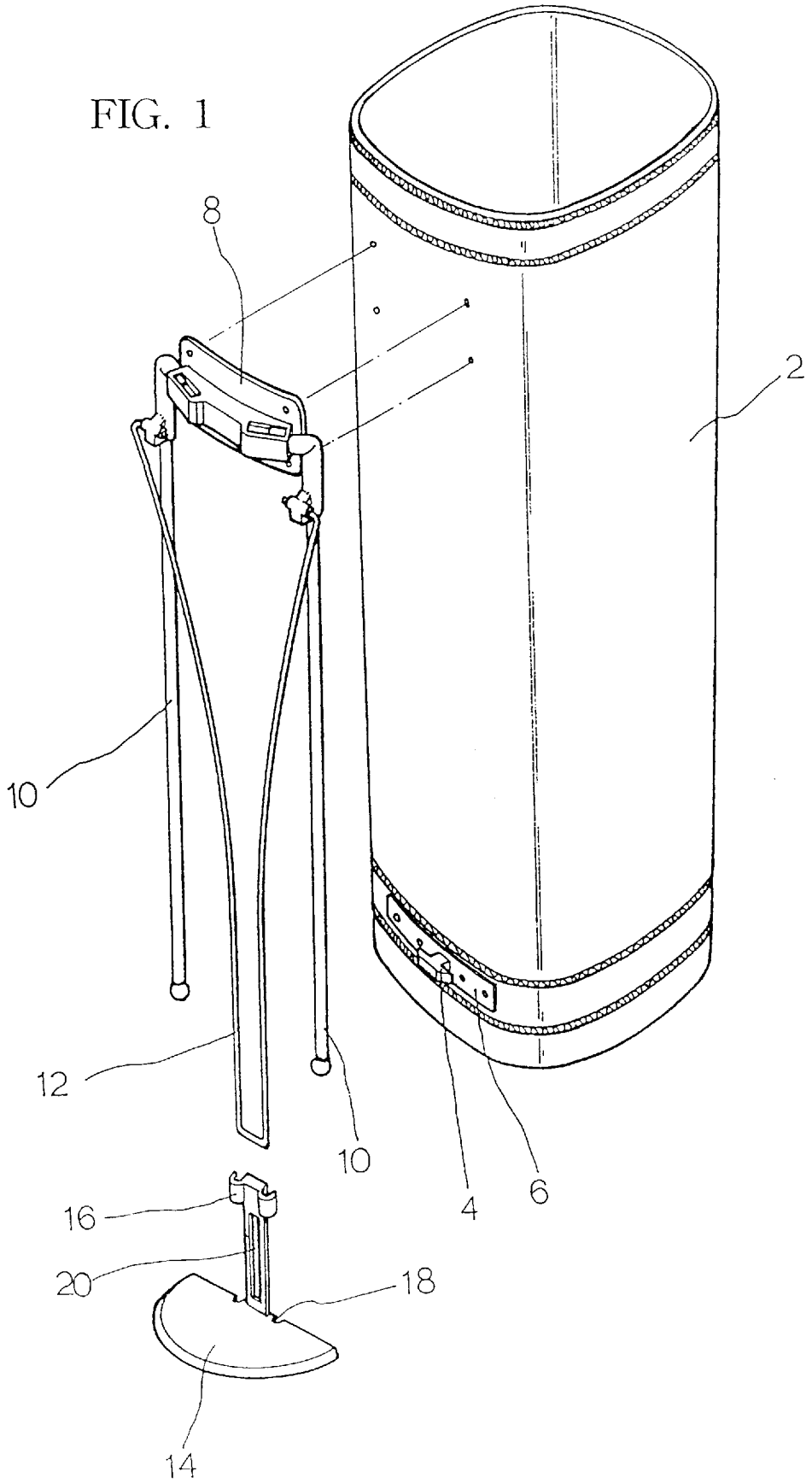
Fig. 1 is a partially exploded perspective view of a golf bag having an automatically foldable support stand according to the present invention.

In FIG. 1, the reference numeral 2 denotes a conventional golf bag.

A guide shoe 4 is attached on the bag 2 at a lower position thereof. In the embodiment shown, it is preferable to dispose the guide shoe 4 on the golf bag 2 with a fixing band 6 interposed between the guide shoe 4 and the golf bag 2. However, it is possible to attach the guide shoe 4 on the golf bag 2 otherwise.

A pair of legs 10 mounted on the golf bag 2 with a bracket 8 interposed between the legs 10 and the golf bag 2 can be spread and retracted, and a V-shaped elastic rod 12 interposed between the legs 10 is interconnected to the legs 10.

The elastic rod 12 is engaged with an elasticity enforcing part 16 and an engagement groove 18 both integrally formed on a semicircular base plate 14.

The elasticity enforcing part 16 is formed integral with the base plate 14 with a guide block 20 extended from the base plate 14, and the guide shoe 4 is penetrated through a slot formed in the guide block 20. The guide shoe 4 has a neck which is narrower than the slot, and a head portion which is broader than the slot.

Figure 2:
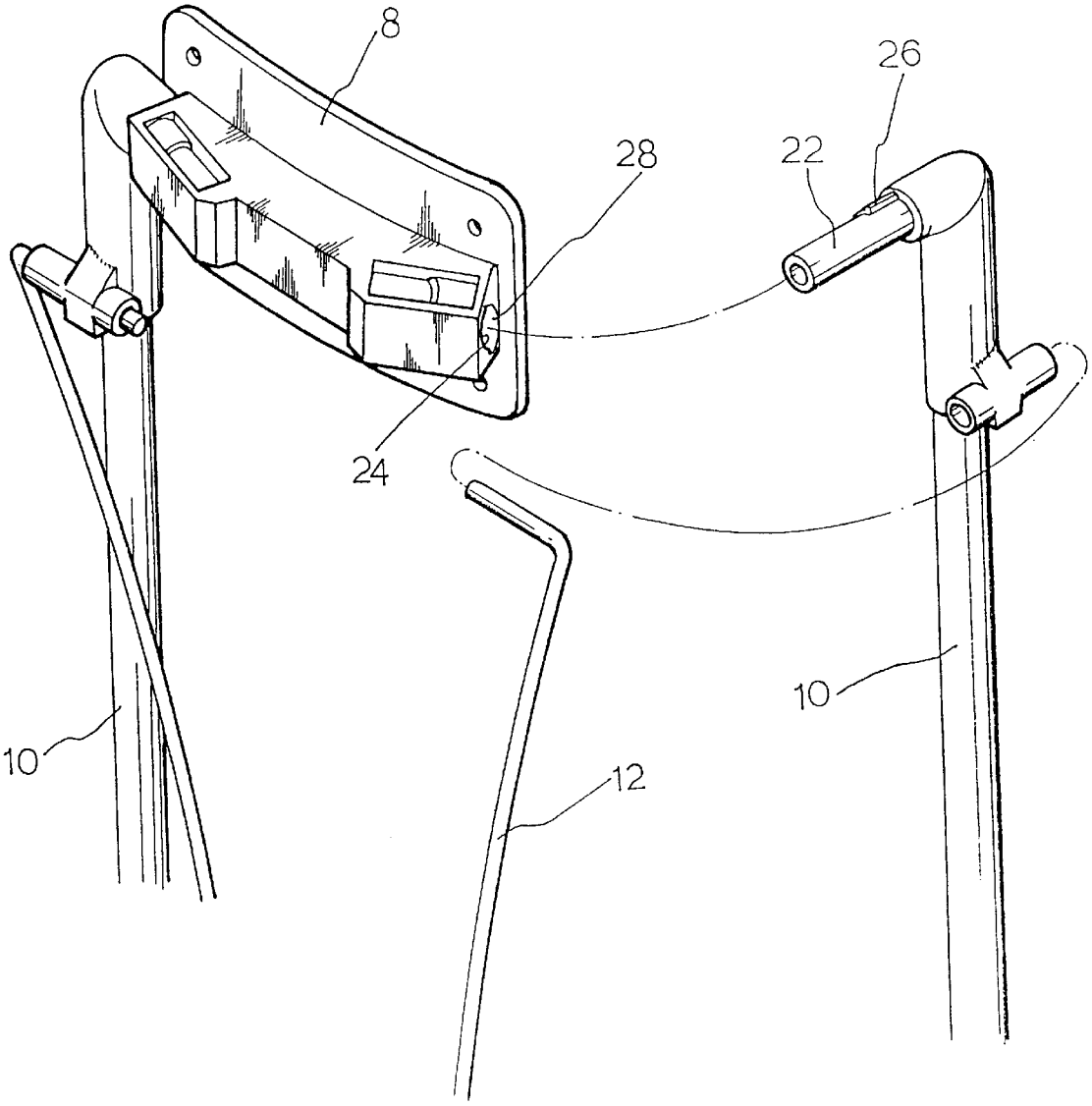
FIG. 2 is a partially exploded perspective view illustrating a structure for connecting legs of the support stand of FIG. 1.

FIG. 2 illustrates a structure wherein a connection shaft 22 of each of the legs 10 is inserted into a corresponding connection hole 24 of the bracket 8 which is fixed on the golf bag 2 whereby the legs 10 are connected with the bracket 8.

The connection shaft 22 has a stopper 26 of a larger diameter protrudingly formed at a predetermined circumferential portion of the connection shaft 22, and a corresponding connection hole 24 of the bracket 8 has an enlarged bore portion 28 formed at an inner peripheral surface of the connection hole 24.

Figure 3A:
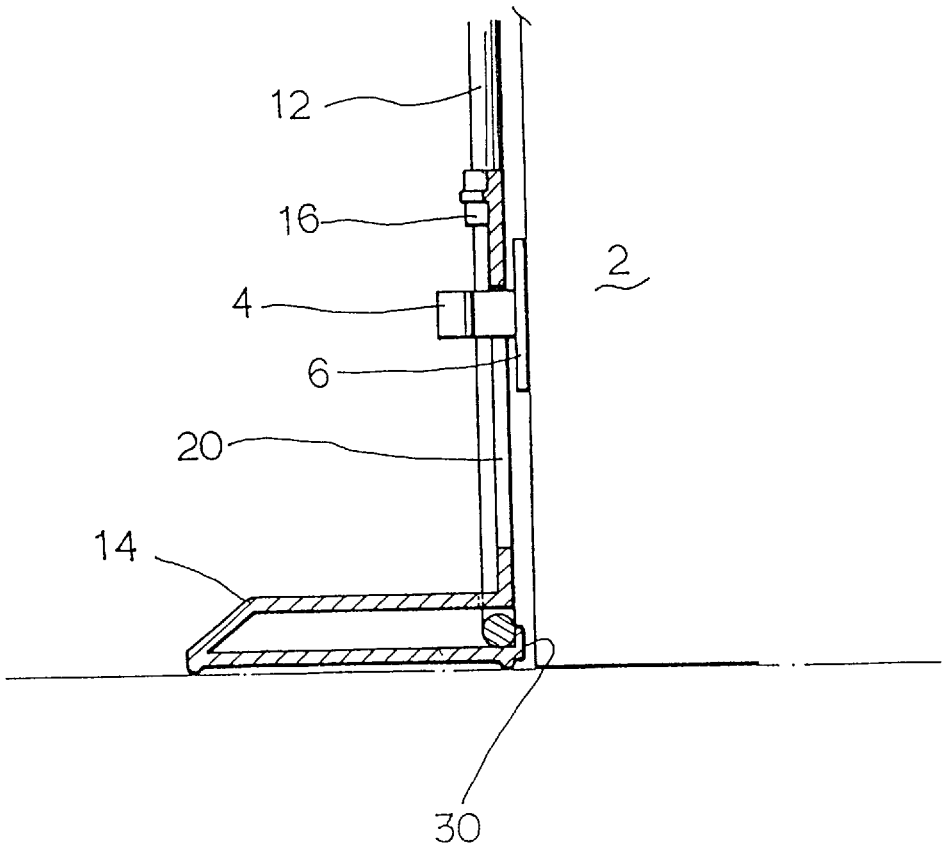

The base plate 14 is placed normally at a height equal to a bottom of the golf bag 2 as shown in FIG. 3A to prevent the legs 10 from being spread when the golf bag 2 is placed upright.

The elasticity enforcing part 16 formed at a predetermined distance from the base plate 14 contributes to shorten the distance between the bracket 8 and a coincidence point from which the elastic rod 12 is diverged into a V-shape, whereby the elastic force of the elastic rod 12 is reinforced substantially. This reinforcement of elasticity endows the elastic rod 12 with enough elastic force to spread and retract the legs 10 even though the thickness of the elastic rod 12 is reduced.

Because a free end of the elastic rod 12 is inserted into the engagement groove 18 of the base plate 14 and engaged with an engagement protrusion 30 formed at the back of the base plate 14 and because the elastic rod 12 is inserted into and fixed by the elasticity enforcing part 16, the elastic rod 12 and the base plate 14 are connected rigidly with each other.

In addition, because the guide shoe 4 fixed on the golf bag 2 is protruded through the guide block 20, the base plate 14 can move up and down following a path formed when the guide block 20 moves along the guide shoe 4.

Accordingly, since a widthwise component of the elastic force of the elastic rod 12 does not cause a friction which will act against the up and down movement of the base plate 14, the movement of the base plate 14 can be performed smoothly.

Figure 3B:
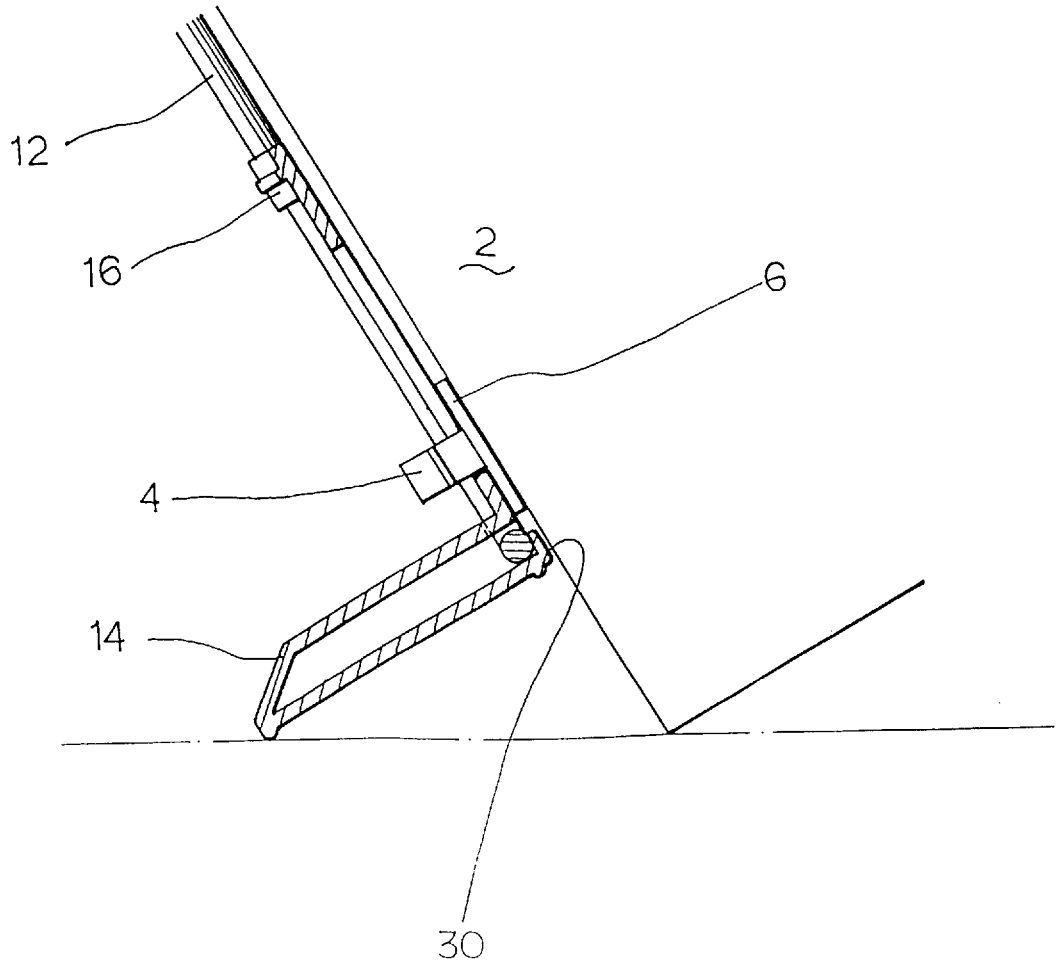
FIG. 3B shows a state when the golf bag is tilted with respect to the ground.

As a user tilts the golf bag 2 with respect to the ground as shown in FIG. 3B, the base plate 14 moving upward along the path formed by the guide shoe 4 pushes the elastic rod 12 up, and the legs 10 become spread by the elastic rod 12.

Figure 4B:
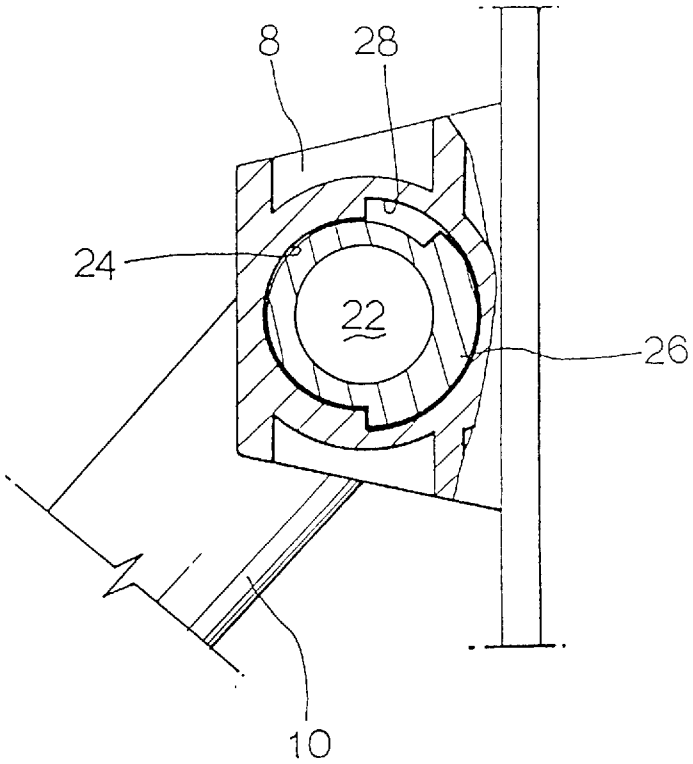
Figure 4A:
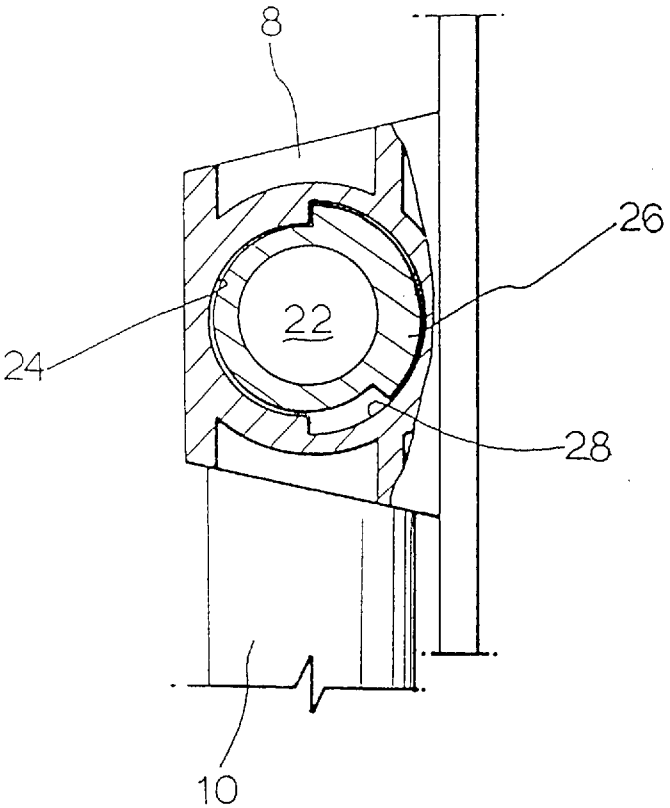
Figure 5B:
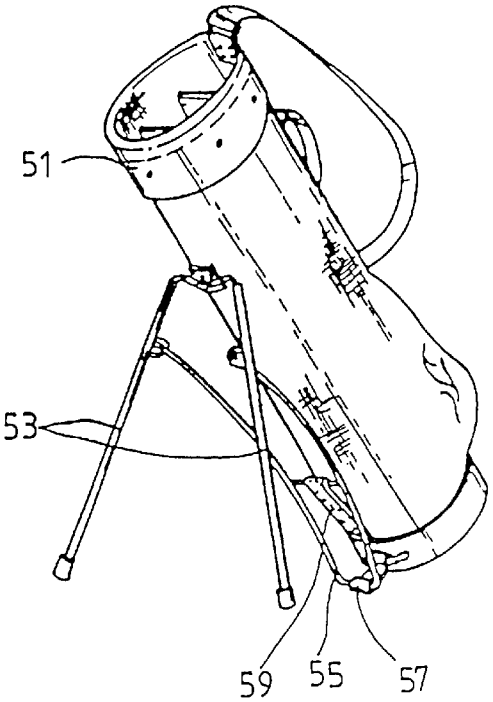
FIG. 5B (PRIOR ART)
Figure 5A:
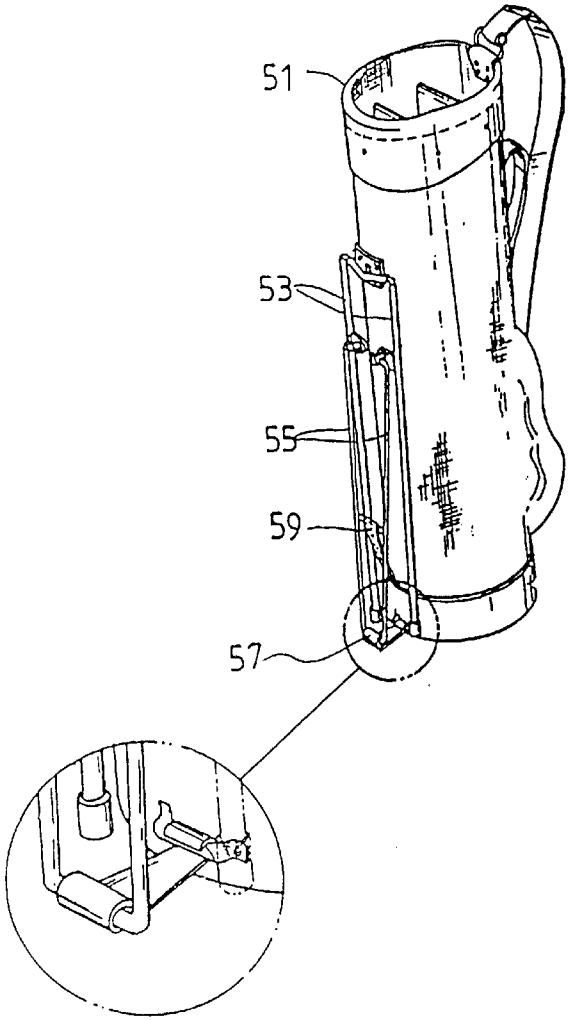
FIG. 5A (PRIOR ART)

Meanwhile, the relationship between the connection hole 24 of the bracket 8 and the connection shaft 22 of the legs 10 are shown in FIGS. 4A and 4B. When the legs 10 are retracted as shown in FIG. 4A, the stopper 26 abuts with one end of the enlarged bore portion 28 and stopped thereby. When the legs 10 are spread as shown in FIG. 4B, the stopper 26 abuts with the other end of the enlarged bore portion 28 and stopped thereby. The spreading angle of the legs 10 is limited to a predetermined range in this way.

Here, the elastic rod 12 keeps exerting elastic force against the legs 10 even after the legs are spread. Therefore, it is possible to adjust the spreading angle of the legs 10 which is limited by the enlarged bore section 28 to a range where the elastic force of the elastic rod 12 become the maximum. In this way, the legs can support the golf bag 2 in a most stable condition free from shake, due to the abutting relationship between the stopper 26 and the enlarged bore portion 28 under the action of the elastic force exerted by the elastic rod 10.

As described and illustrated above, because no friction is generated while the elastic rod moves up and down, the automatically foldable support stand according to the present invention presents a smooth spreading and retracting operation. Also, the coincidence point of the elastic rod is shortened substantially by the elasticity enforcing part such that a relatively slender elastic rod exhibits an enough elastic force. Therefore, the present invention contributes to save production cost and to reduce weight of the golf bag. Further, as the spreading angle of the legs can be limited to an optimum value, the golf bag is supported stably.

What is claimed is:

1. An automatically foldable golf bag support stand having a V-shaped elastic rod actuated by a variation of weight applied thereto, said V-shaped elastic rod being raised or lowered along a guide configured for installation on a lower end of a golf bag thereby spreading or retracting a pair of legs interconnected to said V-shaped elastic rod, characterized in that:

a free end of said V-shaped elastic rod (12) is engaged with an engagement groove (18) of a semicircular base plate (14);

an elasticity enforcing part (16) formed at a top of a guide block (20) which is vertically extended from said semicircular base plate (14) is engaged with said V-shaped elastic rod (12) at a position between an upper end and a lower end of said V-shaped elastic rod (12) thereby shortening a coincidence point of said V-shaped elastic rod (12), said elasticity enforcing part (16) and said guide block (20) being integral parts of said semicircular base plate (14);

said guide block (20) has a slot formed along its height; and said guide including a guide shoe (4) including a neck portion which is narrower than said slot of said guide block (20) and a head portion which is broader than said slot of said guide block (20) and configured for attachment at a lower position of a golf bag penetrates through said guide block (20) whereby an up and down movement of said base plate (14) is guided.

2. A golf bag having an automatically foldable support stand integral thereto, said golf bag comprising:

a V-shaped elastic rod (12) actuated by a variation of weight of said golf bag (2), said V-shaped elastic rod (12) being raised or lowered along a guide installed on a lower end of said golf bag (2) thereby spreading or retracting a pair of legs interconnected to said V-shaped elastic rod (12) to support said golf bag (2) in a tilted posture; characterized in that:

a free end of said V-shaped elastic rod (12) is engaged with an engagement groove (18) of a semicircular base plate (14);

an elasticity enforcing part (16) formed at a top of a guide block (20) which is vertically extended from said semicircular base plate (14) is engaged with said V-shaped elastic rod (12) at a position between an upper end and a lower end of said V-shaped elastic rod (12) thereby shortening a coincidence point of said V-shaped elastic rod (12), said elasticity enforcing part (16) and said guide block (20) being integral parts of said semicircular base plate (14);

said guide block (20) has a slot formed along its height; and said guide including a guide shoe (4) including a neck portion which is narrower than said slot of said guide block (20) and a head portion which is broader than said slot of said guide block (20) and configured for attachment at a lower position of said golf bag (2) penetrates through said guide block (20) whereby an up and down movement of said base plate (14) is guided.

* * * * *